US005390499A

United States Patent [19]

Rhoades et al.

[11] Patent Number: 5,390,499

[45] Date of Patent: Feb. 21, 1995

[54] PROCESS TO INCREASE NATURAL GAS METHANE CONTENT

[75] Inventors: George D. Rhoades, LaGrange; Robert J. Golueke, Naperville, both of Ill.

[73] Assignee: Liquid Carbonic Corporation, Oak Brook, Ill.

[21] Appl. No.: 143,924

[22] Filed: Oct. 27, 1993

[51] Int. Cl.[6] ..... F25J 1/00

[52] U.S. Cl. ..... 62/9; 62/20; 62/23

[58] Field of Search ..... 62/9, 11, 20, 23

[56] References Cited

U.S. PATENT DOCUMENTS

| | | | |
|---|---|---|---|
| 3,318,103 | 2/1964 | Jakob | 62/13 |
| 3,542,673 | 5/1967 | Ringler | 208/340 |
| 3,592,015 | 7/1971 | Streich | 62/28 |
| 3,596,472 | 8/1971 | Streich | 62/28 |
| 3,970,441 | 7/1976 | Etzbach et al. | 62/9 |
| 4,274,850 | 6/1981 | Becker | 62/24 |
| 4,278,457 | 7/1981 | Campbell et al. | 62/24 |
| 4,368,061 | 1/1983 | Mestrallet et al. | 62/28 |
| 4,582,517 | 4/1986 | Burr et al. | 62/24 |
| 4,676,812 | 6/1987 | Kummann | 62/24 |
| 4,707,171 | 11/1987 | Bauer | 62/30 |
| 4,718,927 | 1/1988 | Bauer et al. | 62/39 |
| 4,738,699 | 4/1988 | Apffel | 62/11 |
| 4,746,342 | 5/1988 | DeLong et al. | 62/24 |
| 4,805,413 | 2/1989 | Mitchell et al. | 62/24 |
| 4,851,020 | 11/1989 | Mongtomery, IV | 62/24 |
| 4,854,955 | 8/1989 | Campbell et al. | 62/24 |
| 4,889,545 | 12/1989 | Campbell et al. | 62/24 |
| 4,895,584 | 1/1990 | Buck et al. | 62/29 |
| 4,900,347 | 2/1990 | McCue, Jr. et al. | 62/24 |
| 4,921,514 | 5/1990 | Rowles et al. | 62/24 |
| 4,966,612 | 10/1990 | Bauer | 62/24 |
| 4,970,867 | 11/1990 | Herron et al. | 62/11 |
| 5,114,451 | 5/1992 | Rambo et al. | 62/24 |

*Primary Examiner*—Ronald C. Capossela
*Attorney, Agent, or Firm*—Fitch, Even, Tabin & Flannery

[57] ABSTRACT

The present invention is directed to a process for purifying natural gas to provide a liquified natural gas product which is substantially pure methane. In the process, a natural gas feed stream is introduced into indirect countercurrent heat exchange in a first heat exchanger to cool the natural gas to below the dew point of ethane and higher hydrocarbons so as to separate the feed stream into a gas which is substantially pure methane and liquid which contains the ethane and higher hydrocarbons. The liquid/gas mixture is transferred to a separator where the gas occupies the head space of the separator and the liquid occupies the bottom of the separator. A gas fraction is removed from the top of the separator and is introduced into countercurrent heat exchange with liquid nitrogen in a second heat exchanger so as to liquefy the substantially pure methane gas. Liquid nitrogen is introduced into a third heat exchanger where the liquid nitrogen is mixed with a recycled portion of nitrogen vapor is mixed with a recycled portion of nitrogen vapor exiting from the second heat exchanger to provide a liquid nitrogen feed stream for the second heat exchanger.

13 Claims, 1 Drawing Sheet

PROCESS TO INCREASE NATURAL GAS METHANE CONTENT

FIELD OF THE INVENTION

The present invention relates generally to a process for purifying a natural gas stream by a cryogenic process to provide a purified natural gas which can be used as fuel in internal combustion engines. More particularly, the present invention relates to a cryogenic process for purifying natural gas utilizing liquid nitrogen as the refrigerant to produce a liquid natural gas product.

BACKGROUND OF THE INVENTION

Liquid natural gas qualifies as a desirable alternative fuel for internal combustion engines. A major problem associated with the use of liquid natural gas as a fuel for internal combustion engines is that liquid natural gas is a mixture of about 90 to 95% methane with higher hydrocarbons, the principal higher hydrocarbon being ethane, usually in the range of from about 4% to about 7%.

The hydrocarbons higher than methane create several problems for the utilization of liquid natural gas as a fuel for internal combustion engines. First, the higher hydrocarbons have lower auto ignition temperatures than methane.

| Component | Critical Compression Ratio | Auto Ignition Temperature |
|---|---|---|
| methane | 13.0 | 540° C. |
| ethane | 9.8 | 515° C. |
| propane | 8.8 | 450° C. |
| butane | 5.3 | 405° C. |
| pentane | 3.5 | 260° C. |

The composition of natural gas and, therefore, the percentage of higher hydrocarbons varies widely dependent on the source. Such variation in composition denies engine manufacturers the opportunity to maximize engine designs. The higher hydrocarbons in the liquid natural gas fuel can preignite and result in preignition of the methane. This causes knock, hot spots and eventual engine failure.

Many processes have been devised for the cryogenic separation of heavier components from a natural gas stream and disposing the waste "dirty" methane stream usually by returning it to the pipeline. Among these are U.S. Pat. Nos. 4,072,485 to Becdelievre, et al.; 4,022,597 to Bacon; 3,929,438 to Harper; 3,808,826 to Harper, et al.; Re. 29,914 to Perret; Re 30,085 to Perret; 3,414,819 to Grunberg, et al.; 3,763,658 to Gaumer, Jr., et al.; 3,581,510 to Hughes; 4,140,504 to Campbell, et al.; 4,157,904 to Campbell, et al.; 4,171,964 to Campbell, et al.; 4,278,457 to Campbell, et al.; 3,932,154 to Coers, et al.; 3,914,949 to Maher, et al. and 4,033,735 to Swenson.

Such prior art processes for separation of heavier components utilize complex heat exchange schemes usually involving fractionation in a distillation column. Exemplary of such processes is U.S. Pat. No. 4,738,699 to Apffel. The Apffel patent discloses a method for use of a mixed refrigeration stream for removing higher hydrocarbons from methane of a natural gas stream. The mixed refrigeration system uses two-phase flow for refrigeration to facilitate separation of the hydrocarbon components, such as ethane, propane and heavier gases from methane and lighter constituents of the natural gas stream. The separation process is accomplished in two stages. First, the inlet gas stream is cooled in exchange with a refrigerant and residue gas and partially condensed. Second, the condensed mixture and the vapor stream are fed to a fractionation tower, where the desired hydrocarbons are separated from methane and lighter gases using indirect heat exchange with the mixed refrigerant, and a slip stream from the initial feed stream, alternately to provide the energy for distillation.

It is a principle object of the present invention to provide a simple means for providing a purified methane product suitable for use in internal combustion engines utilizing liquid nitrogen as the driving force for the purification and the liquefication of the natural gas.

SUMMARY OF THE INVENTION

Figure 1:
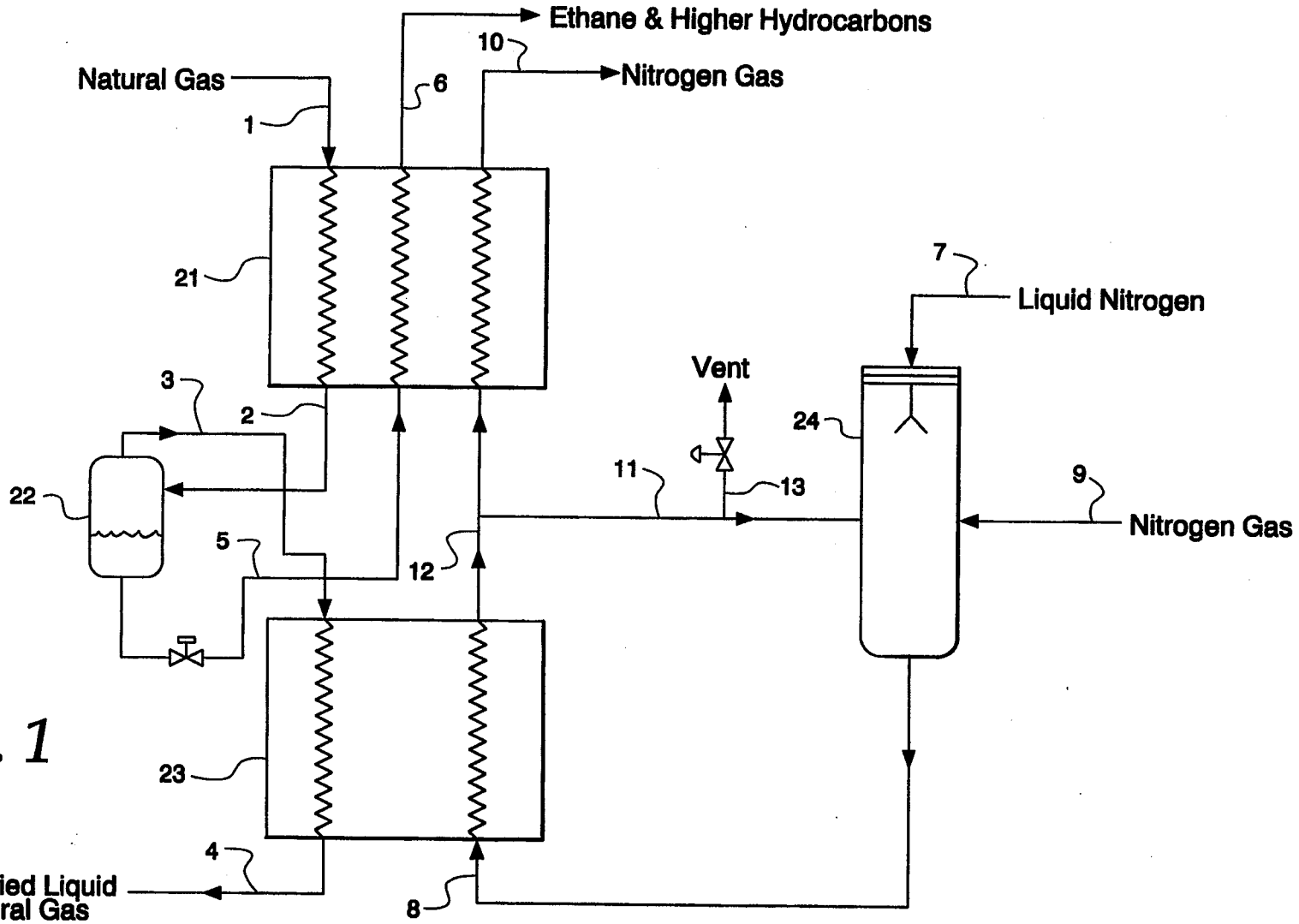
FIG. 1 is a flow diagram of the process of the present invention for purifying natural gas.

The present invention is directed to a process for purifying natural gas to provide a liquified natural gas product which is substantially pure methane. In the process, a natural gas feed stream is introduced into indirect countercurrent heat exchange in a first heat exchanger to cool the natural gas to below the dew point of ethane and higher hydrocarbons so as to separate the feed stream into a gas which is substantially pure methane and liquid which contains the ethane and higher hydrocarbons. The liquid/gas mixture is transferred to a separator where the gas occupies the head space of the separator and the liquid occupies the bottom of the separator. A gas fraction is removed from the top of the separator and is introduced into countercurrent heat exchange with liquid nitrogen in a second heat exchanger so as to liquefy the substantially pure methane gas. Liquid nitrogen is introduced into a third heat exchanger where the liquid nitrogen is mixed with a recycled portion of nitrogen vapor is mixed with a recycled portion of nitrogen vapor exiting from the second heat exchanger to provide a liquid nitrogen feed stream for the second heat exchanger. The nitrogen vapor exiting from the second heat exchanger is divided into a recycle portion for introduction into the third heat exchanger and a heat exchange portion for introduction into countercurrent heat exchange with the natural gas feed stream in the first heat exchanger. A liquid fraction containing $C_2$ and higher hydrocarbons is removed from the bottom of the separator. The liquid fraction removed from the bottom of the separator is introduced into indirect countercurrent heat exchange with the natural gas feed stream in the first heat exchanger.

DETAILED DESCRIPTION OF THE INVENTION

Referring now to FIG. 1, a natural gas stream 1 is introduced into a first heat exchanger 21. The natural gas stream 1 is cooled in heat exchanger 21 to a temperature below its dew point to provide a stream 2 which is a mixture of a gas which is substantially methane and a liquid containing some methane and substantially all of the $C_2$ and higher hydrocarbons. The stream 2 is introduced into separator 22 where the liquid mixture is separated from the gas. Separation of the gas and liquid may be facilitated by use of baffle plates or other means to separate entrained gas from liquids. The methane gas stream 3 is transferred to a second heat exchanger 23 where it is transferred in countercurrent heat exchange with liquid nitrogen so as to provide a purified liquid natural gas product 4 which is substantially methane.

Liquid nitrogen is sprayed into the top of a third heat exchanger 24. Liquid nitrogen is most often commercially available at a temperature of −320° F. and a pressure of about 205 psia. The liquefication temperature of nitrogen at a pressure of 14.7 psia is about −320° F. The nitrogen is pressurized to approximately 205 psia to feed exchanger 24.

The purified natural gas leaving the first heat exchanger and entering the second heat exchanger is saturated at its condensing temperature. The nitrogen cooling the second heat exchanger cannot leave the second heat exchanger warmer than,the temperature of the natural gas entering the second heat exchanger. This means that most of the nitrogen vapor sensible refrigeration leaving the second heat exchanger is available to be used to cool the warm incoming natural gas stream 1. A heat balance shows that this refrigeration combined with the refrigeration of the vaporizing liquid stream 5 is more than is needed for the first heat exchanger condensation. To overcome this problem, and to provide an incoming liquid nitrogen stream more suitable for liquefying natural gas stream 3, a fraction of the cold nitrogen vapor stream 12 exiting from the second heat exchanger is recycled to the third heat exchanger where it is recondensed by the incoming stream of liquid nitrogen 7. Recycling of nitrogen vapor stream 11 to the third heat exchanger 24 warms the liquid nitrogen to a new equilibrium pressure by recondensing the cold nitrogen vapor stream 11 leaving the second heat exchanger 23. This has two advantages; these being that less incoming liquid nitrogen is required and the incoming liquid nitrogen stream 8 into second heat exchanger 23 is closer to the desired exit temperature of the liquid natural gas stream 4 which eliminates heat exchanger stress caused by large temperature differences and also prevents subcooling the liquid natural gas stream 4.

A nitrogen gas stream 9 can also be introduced into third heat exchanger 24 to further control the temperature and pressure of liquid nitrogen stream 7. The combination of the introduction of nitrogen gas, recycle of nitrogen gas from the second heat exchanger 23 and venting of nitrogen gas at stream 13 can be used in combination to control the composition of the heavy liquid stream or fraction 5 leaving separator 22, particularly the level of methane contained in heavy liquid stream 5.

The heavy liquid fraction 5 removed from the bottom of separator 22 along with the portion of nitrogen vapor leaving second heat exchanger 23 which is not recycled, is transferred in countercurrent heat exchange with the natural gas stream 1 entering the first heat exchanger 21.

The following table 1 sets forth the range of temperatures, pressures and ratios which can be used in the process of the present invention for producing purified liquid natural gas.

TABLE 1

| Identification | Range of Temp. °F. | Pressure Psia | Ratio–Mole % |
|---|---|---|---|
| Natural Gas Stream 1 | 40–90 | 35–110 | |
| Purified Natural Gas Stream 4 | −235 to −270 | 20–100 | |
| Liquid Nitrogen Stream 7 | −250 to −320 | 165–226 | |
| Liquid Stream 5 from Separator 22 | −180 to −260 | 30–105 | |
| Gas Stream 3 from Separator 22 | −180 to −215 | 25–105 | |
| Nitrogen Gas Stream 9 | 40 to 100 | 170–300 | |
| Ratio of Liquid Nitrogen Stream 7 to Natural Gas Stream 1 | NA | NA | 1.3:1–1.8:1 |
| Ratio of Total Nitrogen Stream 12 to Recycle Nitrogen Stream 11 | NA | NA | 7:1–3:1 |
| Level of Nitrogen Gas to Liquid Nitrogen | NA | NA | 0–3% $N_2$ Gas |
| Nitrogen Gas Stream 12 | −205 to −265 | 150–180 | |
| Nitrogen Gas Stream 10 | 0 to 80 | 140–160 | |
| Hydrocarbon Gas Stream 6 | −20 to −60 | 30–50 | |

The following table 2 illustrates the operating parameters which may be used to produce 23,000 gallons per day of purified liquid natural gas.

TABLE 2

| Stream # | 1 | 2 | 3 | 4* | 5 | 6 | 7 | 8 | 9 | 10 | 11* |
|---|---|---|---|---|---|---|---|---|---|---|---|
| LB Moles/Hr | 220 | 220 | 212.5 | 212.5 | 7.5 | 7.5 | 266.7 | 340 | 6.3 | 273 | |
| MSCFH | 83.3 | 83.3 | 80.4 | 80.4 | 2.9 | 2.9 | 101.2 | 129 | 2.4 | 103.6 | 25.4 |
| Psia | 80 | 74 | 70 | 68 | 45 | 40 | 205 | 162 | 162 | 150 | 162 |
| Temp. °F. | 70 | −207 | −207 | −260 | −225 | 45 | −320 | −270 | 60 | 45 | −214 |
| Mole Wt | 16.18 | 16.18 | 16.1 | 16.1 | 18.39 | 18.39 | 28.016 | 28.016 | 28.01 | 28.01 | 28.0 |
| $C_1H_4$ | 99.04 | 99.04 | 99.56 | 99.56 | 84.4 | 84.4 | 0 | 0 | 0 | 0 | 0 |
| $C_2H_5$ | 0.69 | 0.69 | 0.20 | 0.20 | 14.42 | 14.42 | 0 | 0 | 0 | 0 | 0 |
| $C_3H_8$ | 0.04 | 0.04 | 0 | 0 | 1.15 | 1.15 | 0 | 0 | 0 | 0 | 0 |
| $N_2$ | 0.23 | 0.23 | 0.24 | 0.24 | 0.0 | 0.0 | 100 | 100 | 100 | 100 | 100 |
| $CO_2$ | 0 | 0 | 0 | 0 | 0 | 0 | 0 | 0 | 0 | 0 | 0 |

*Gal/Day - #4 = 23040
- #7 = 26043

While the description of the process of the present invention has been described with respect to separate first heat exchanger 21 and second heat exchanger 23, it is apparent that these heat exchangers can be combined into a single heat exchanger with appropriate entrance and take-off points for the various streams entering and leaving the two heat exchangers.

What is claimed is:

1. A process for purifying natural gas comprising:

(a) introducing a natural gas feed stream into indirect countercurrent heat exchange in a first heat exchanger to cool said natural gas to the dew point of $C_2$ and higher hydrocarbons so as to provide a mixture consisting of a gas which is substantially pure methane and a liquid containing $C_2$ and higher hydrocarbons;

(b) transferring said mixture to a separator;

(c) removing a gas fraction from the top of said separator and introducing said gas fraction to a second heat exchanger into countercurrent heat exchange with liquid nitrogen so as to provide a purified liquid methane product, (d) introducing liquid nitrogen into a third heat exchanger where said liquid nitrogen is mixed with a recycle portion of gaseous nitrogen exiting from said second heat exchanger to provide a liquid nitrogen feed stream for said second heat exchanger;

(e) dividing the gaseous nitrogen exiting from said second heat exchanger into a recycle portion for introduction into said third heat exchanger and a heat exchange portion for introduction into indirect countercurrent heat exchange with said natural gas feed stream into said first heat exchanger; and (f) removing a liquid fraction containing $C_2$ and higher hydrocarbons from the bottom of said separator and introducing said liquid fraction into indirect countercurrent heat exchange with said natural gas feed stream in said first heat exchanger.

2. A process in accordance with claim 1 wherein the ratio of said liquid nitrogen to said natural gas feed is from about 1.3:1 to about 1.8:1.

3. A process in accordance with claim 1 wherein the ratio of said total nitrogen exiting from said second heat exchanger to said recycle nitrogen fraction is from about 7:1 to about 3:1.

4. A process in accordance with claim 1 wherein said dew point temperature to which said natural gas feed is cooled in said first heat exchanger is from about −180° F. to about −260° F.

5. A process in accordance with claim 1 wherein said natural gas feed stream is at a temperature of from about 40° F. to about 90° F. and a pressure of from about 35 psia to 110 psia.

6. A process in accordance with claim 1 wherein the pressure of said liquid fraction is reduced prior to introduction of said liquid fraction into said first heat exchanger.

7. A process in accordance with claim 1 wherein nitrogen gas is introduced into said third heat exchanger.

8. A process in accordance with claim 5 wherein said nitrogen gas is introduced at a level of from about 1 mole % to about 3 mole % of the level of liquid nitrogen.

9. A process in accordance with claim 1 wherein said liquid nitrogen introduced into said second heat exchanger is at a temperature of from about −250° F. to about −280° F. and a pressure of from about 130 psia to about 170 psia.

10. A process in accordance with claim 1 wherein said nitrogen gas is at a temperature of from about 40° F. to about 100° F. and is at a pressure of from about 170 psia to about 300 psia.

11. A process in accordance with claim 1 wherein the temperature of said nitrogen gas exiting from said second heat exchanger is from about −205° F. to about −265° F.

12. A process in accordance with claim 1 wherein said nitrogen exits from said first heat exchanger at a temperature of from about 0° F. to about 80° F.

13. A process in accordance with claim 1 wherein said liquid hydrocarbon exits from said first heat exchanger as a gas at a temperature of from about−−−20° F. to about 60° F.

* * * * *